United States Patent [19]

Hosaka et al.

[11] Patent Number: 4,653,427

[45] Date of Patent: Mar. 31, 1987

[54] NON-CONTACT DEVELOPMENT METHOD AND APPARATUS UNDER TANGENTIAL MAGNETIC FIELD AND AC FIELD

[75] Inventors: Akihito Hosaka, Yokohama; Koichi Kinoshita, Shizuokashi, both of Japan

[73] Assignee: Canon Kabushiki Kaisha, Tokyo, Japan

[21] Appl. No.: 731,039

[22] Filed: May 6, 1985

[30] Foreign Application Priority Data

May 16, 1984 [JP] Japan ..... 59-98424
Jan. 9, 1985 [JP] Japan ..... 60-1887

[51] Int. Cl.[4] ..... G03G 15/09
[52] U.S. Cl. ..... 118/658; 430/122
[58] Field of Search ..... 430/120, 122; 118/657, 118/658

[56] References Cited

U.S. PATENT DOCUMENTS 4,511,239 4/1985 Kanbe et al. ..... 118/658
4,525,056 6/1985 Itaya et al. ..... 118/658
4,540,645 9/1985 Honda et al. ..... 430/122

*Primary Examiner*—John L. Goodrow

*Attorney, Agent, or Firm*—Fitzpatrick, Cella, Harper & Scinto

[57] ABSTRACT

A method and apparatus for development. A layer of developer which is a mixture of insulative magnetic particles and toner particles is carried on a surface of a developing sleeve which accommodates therein a magnet roller. A latent image bearing member carrying a latent image to be developed is so opposed to the developing sleeve that the latent image bearing member to a portion of the magnet roller which is between the two adjacent magnetic poles. The surfaces of the latent image bearing member and the developer carrying member are maintained with a clearance which is larger than the thickness of the developer layer. An alternating electric field is formed in or across the clearance to alternatingly repeat two steps, i.e., a toner transferring step wherein the toner particles are transferred from the developer layer on the developer carrying sleeve to the latent image bearing member, irrespective of whether it is the image area or whether it is non-image area, and a back transfer step wherein excessive toner particles are transferred back to the developer carrying member, whereby a developed image is provided.

30 Claims, 4 Drawing Figures

NON-CONTACT DEVELOPMENT METHOD AND APPARATUS UNDER TANGENTIAL MAGNETIC FIELD AND AC FIELD

BACKGROUND OF THE INVENTION

The present invention relates to a developing method and a developing apparatus of non-contact type for developing a latent image.

It is known, as disclosed in U.S. Pat. Nos. 4,292,387 and 4,395,476 for example, that one component, insulative and magnetic toner or non-magnetic toner is applied on a surface of a developer carrying member and is conveyed thereon to a developing station, where the thin layer of the toner is opposed with a clearance to a surface of a latent image bearing member. An alternating voltage is applied at this station so as to transport the toner from the developer carrying member to the latent image bearing member so as to develop the latent image, thus effecting the developing action without contacting the thin toner layer with the latent image bearing member.

However, the developing method or apparatus of this type involves the following problem. When an attempt is made to positively charge with certainty the toner particles on the developer carrying member surface to the intended polarity which is required for the movement of the toner particles in the developing station, the thickness of the toner layer on the developer carrying member surface becomes thin so that the density of the developed image is low, particularly in the case of a solid black part of the image. This will be explained further. When a latent image consisting of letters or characters is developed, the toner particles come to the letter portions not only from the area of the toner layer exactly opposed to the letter portions but also from the area in the neighborhood thereof by the alternating electric field, whereby a developed image of a sufficient density can be provided. When, on the other hand, a solid black image or a thick line image is developed, the amount of the thin layer toner particles on the developer carrying member surface tends to be insufficient, and the toner is concentrated at the edges of the latent image with the result that the developed image is formed with an insufficient amount of the toner particles.

When the magnetic toner particles each consisting of magnetic material and resin, it is difficult to reproduce an image in a bright non-black color since the magnetic toner particles contain the magnetic material, which is usually black in color. Therefore, for a color reproduction, non-magnetic toner mainly comprised of resin is used exclusively. However, the tendency of the lack of the toner in the solid black image is observed more remarkably when non-magnetic toner particles are used than when the magnetic toner particles are used. For those reasons, the above described problems are more significant when the color development is to be carried out than when monochromatic development. Particularly, in the case of a high quality development for a pictorial color reproduction, the above described edge effects and the lack of density in the solid image are significant problems.

Further, as one of non-contact type developing method, a proposal has been made wherein a developer including insulating toner particles mixed with conductive and magnetic carrier particles (hereinafter will be called "conductive carrier") is applied on the surface of the developer carrying member, the applied layer of the developer is opposed with a clearance to the surface of the latent image bearing member with an alternating voltage applied across the clearance so as to transit the toner particles from the layer to the latent image bearing member to develop the same.

This type of developing method involves the following drawbacks. In the developing action when the developer layer is opposed to the latent image bearing member with the alternating voltage applied across the clearance, the developer reciprocates across the clearance, resulting in the toner particles deposited to the image part (the part to which the toner should be deposited) of the latent image. It is required in order to obtain the desirable development that only the toner particles reciprocate or transit, but actually the conductive carrier particles also move to the latent image bearing member. As a result, the carrier particles can impinge on the toner particles already deposited on the image part of the latent image, which causes the deposited toner particles to scatter around. This disturbs the image to degrade the quality thereof. Additionally, when the conductive carrier particles reach the image part, they neutralize the electric charge of the latent image, thus reducing the image density. Furthermore, when the voltage is increased in an attempt to broaden the area of the voltage application, a spark discharge can take place across the clearance, which will destroy the latent image and additionally which can damage the latent image bearing surface. This occurs more easily when the resistance of the developer layer is low, so that the tolerable range of the AC voltage is very narrow. Moreover, if the conductive carrier particles are transferred to and deposited on the latent image bearing member surface, they are not transferred to a transfer material in the subsequent image transfer station, and therefore, they reach the cleaning station by being conveyed on the latent image bearing member. Then, the latent image bearing surface is "abraded" with the conductive carrier particles, which can damage the latent image bearing surface.

U.S. Pat. No. 4,450,220 proposes a non-contact developing method which uses two component developer with insulative carrier particles. U.S. patent application Ser. No. 632,887 proposes a non-contact developing method with the use of flat carrier particles. In those developing method, a developing magnet pole is opposed to the latent image bearing member in the developing station. Accordingly, the magnetic particles are formed into a magnetic brush in the developing station so that the thickness of the developer layer is not uniform there. This means that the distance or clearance between the developer layer and the latent image bearing member is not constant. As a result, when an alternating voltage is applied across the clearance, the strength of the electric field formed in the clearance is not uniform, which may lead to the occurrence of undesirable discharge.

SUMMARY OF THE INVENTION

Accordingly, it is a principal object of the present invention to provide a developing method or a developing apparatus of a non-contact type which is substantially free from all of the above described drawbacks, and which exhibits less edge effect and can reproduce a solid black in a satisfactory density. The apparatus and the method is applicable to a pictorial color reproduction with a high quality of the image.

According to an embodiment of the present invention, insulative and magnetic particles are used and are mixed with insulative toner particles. The mixture is applied on the developer carrying member as a developer layer. The developer layer is opposed to the latent image bearing member with a clearance. They are opposed in the position which is between magnetic poles of magnetic field generating means. An alternating electric field is formed in the developing station to transfer the toner particles. The insulative magnetic particles do not transfer to the latent image bearing member even when the electric voltage is applied, and no electric discharge takes place. Therefore, a constantly stabilized quality of the image can be provided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
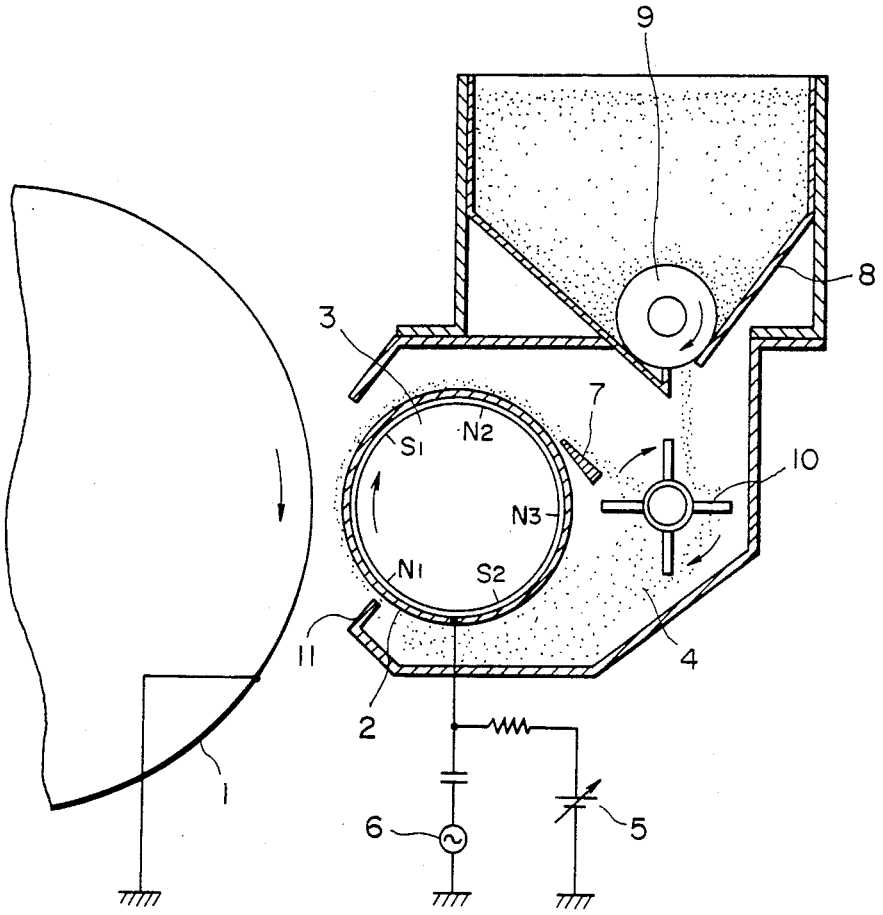
FIG. 1 is a sectional view of a developing apparatus according to an embodiment of the present invention.

Referring now to FIG. 1, there is shown a sectional view of a developing apparatus according to a first embodiment of the present invention, wherein a photosensitive drum, as the latent image bearing member, is depicted by a reference numeral 1 and is effective to bear a latent image. The developing apparatus comprises a developing sleeve 2 of non-magnetic material, as the developer carrying member, and a fixed magnet roll 3 as a magnetic field producing means. The developer which is a mixture of ferrite carrier particles (magnetic particles) and toner particles is designated by a reference numeral 4. The developer mixture is supplied to the developing sleeve 2. The developing apparatus further includes a DC electric power source 5 for supplying a DC voltage to the developing sleeve 2, an AC power source 6 for supplying an AC voltage to the developing sleeve 2, a scraper blade 7, a hopper 8 for accommodating the toner particles, a toner supplying roller 9 and a stirring member 10.

The developer used in this embodiment was constituted by 75 g of ferrite particles having the average particle size of 25 microns as the developer particles and 25 g of the toner particles having the average particle size of 15 microns which were positively chargeable. They were mixed together. The magnet roll 3 had the surface magnetic field strength of 1000 Gauss. With this magnetic field, the above described developer was deposited on the developing sleeve surface. The thickness of the layer of the developer containing the toner and the magnetic particles was controlled by a doctor blade 11 so as to provide a clearance of 100 microns in the position where the developer layer is closest to the latent image bearing member surface. The rotational directions of the latent image bearing member 1 and the developing sleeve 2 are as shown by the arrows in FIG. 1 so as to provide a higher relative speed therebetween. This is effective to increase the image density. However, the latent image bearing member 1 and the developing sleeve 2 may be rotated in such directions that they move in the same direction in the developing station where they are opposed, or that the relative speed therebetween is zero.

The back electrode of the latent image bearing member is grounded. An alternating voltage of 1 KHz having an effective voltage of 0.7 KV and a DC voltage of −100 V were applied to the developing sleeve 2. The clearance between the developing sleeve 2 and the latent image bearing member 1 was 300 microns. With those structures, a latent image having a dark potential of −600 V and the light (background) potential of −50 V was developed. It has been confirmed that the dark part of the image is visualized in a sufficient image density, and in the light part, no toner is deposited there. The visualized image was transferred onto paper, film and another toner image bearing member, thus providing the transferred image. It is a possible alternative that the electrostatic latent image is formed on electrostatic recording paper, and then it is fixed after development.

In the embodiment described above, it has been confirmed that the toner particles repeatedly reciprocate across the clearance between the latent image bearing member 1 and the developing sleeve 2 when the electric voltage is applied to form the corresponding electric field, however, the magnetic particles do not move to the latent image bearing member. More particularly, the magnetic particles can retain electrostatic charge of the polarity opposite that of the toner particles, and therefore are attached to the surface of the sleeve 2 by an image force of the electrostatic charge on the sleeve side. Additionally, the magnetic particles are retained by the magnetic retaining force applied thereto by the fixed magnet roller existing behind the developing sleeve 2. For those reasons, the magnetic particles are not transferred. Thus, the magnetic particles do not disturb the image, and a high quality of the images is provided.

When non-magnetic material having low resistance, for example, aluminum powder, was mixed into the developer of this embodiment, that material moved around at random back and forth and leftwardly and rightwardly without the directional nature as in the toner reciprocation. Therefore, it has been confirmed that it is preferable not to mix the low resistance material, and that it is preferable for the magnetic particles to be insulative. In the foregoing example, ferrite was used as for the magnetic particles. The resistance of the ferrite was $10^{13}$ ohm.cm measured when it is sandwiched without pressure between electrodes under the electric field of 1000 V/cm$^2$. It has been empirically confirmed that the volume resistivity of the magnetic particles of the insulative nature is preferably not less than $10^{12}$ ohm.cm, more preferbly not less than $10^{13}$ ohm.cm. The average particle size of the ferrite is preferably not more than 17 microns, because, if it is less, the magnetic force received by the magnetic particles is weak enough to cause the transfer.

As for the insulative magnetic particles, besides the above described ferrite, any material can be used, such as magnetic oxide powder of electrically insulative nature and magnetic particles coated with insulative resin, for example, the magnetic particles obtained by iron particles having the average particle size of 25 microns coated with acrylic resin having the thickness of approximately 5 microns. When magnetic particles composed of a resin in which magnetic powder is dispersed is used, the magnetic force received by the particle is reduced, corresponding to the volume of the resin part, with the result that the tendency is increased toward transferring to the surface of the latent image bearing member. To obviate this, the particle size has to be larger as compared with the case where only the ferrite is used. It follows that when a smaller particle size is used, it is preferable that the entirety of the magnetic particle or the entirety of the inside of the magnetic particle is constituted by magnetic material. As for the shape of the magnetic particle, a sphere is preferable because it is difficult that an electric field concentration occurs and that the discharge occurs.

Figure 2:
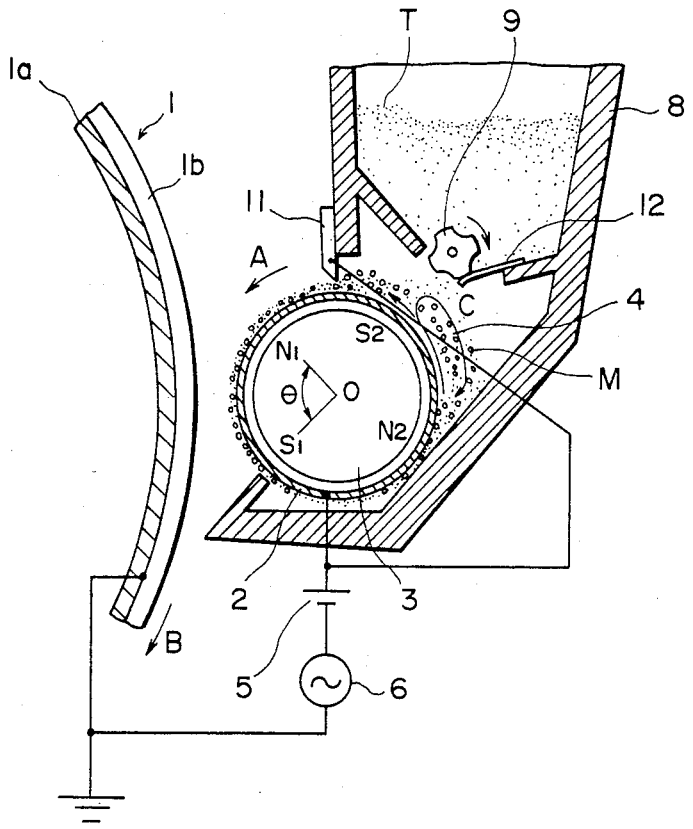
FIG. 2 is a somewhat schematic sectional view of a developing apparatus according to another embodiment.

FIG. 2 is a sectional view of a developing apparatus according to another embodiment of the present invention, wherein an electrostatic latent image bearing member, designated by a reference numeral 1, includes a back electrode 1*a* and an electrostatic latent image bearing layer 1*b* which may be an insulating layer or an electrophotographic photosensitive layer. In this embodiment it is shown as a photosensitive drum 1. The developing apparatus comprises a developer carrying member 2 in the form of an electrically conductive sleeve 2 of non-magnetic material rotatable in the direction shown by an arrow A, magnetic field generating means 3 fixed within the sleeve 2, in the form of a magnet roller having four magnetic poles in this embodiment. Developer 4 includes magnetic particles M containing a resin and magnetic powder therein and non-magnetic particles (toner particles) T, mixed thereto, mainly composed of a resin and having an average particle size which is smaller than that of the magnetic particles. Between the sleeve 2 and the back electrode 1*a* of the photosensitive drum 1 which is rotatable in the direction indicated by an arrow B, a developing bias voltage is applied by a DC power source 5 and an AC power source 6. The developing apparatus further comprises a resilient member 12, a toner supplying roller 9 and a developer layer regulating member 11 which is a doctor blade in this embodiment. The same reference numerals as in FIG. 1 embodiment are assigned to the elements having the corresponding functions.

The sleeve 2 is disposed, with a clearance of 200–800 microns, preferably 300–600 microns, opposed to the photosensitive drum 1 bearing an electrostatic latent image to be developed on its surface and rotating in the direction of the arrow B. The clearance can be formed and maintained by known mechanism, for example, by spacer rolls concentrically mounted to the opposite longitudinal ends of the sleeve 2 and kept contacted to the surface of the photosensitive drum 1.

The toner supplying roller 9 has a plurality of recesses on the surface thereof and rotates slowly by a driving gear (not shown) of the sleeve 2 meshed with a driving gear (not shown) of the photosensitive drum 1. With the slow rotation of the toner supplying roller 9, the non-magnetic particles (toner particles) T in the hopper 8 gradually fall into the lower developer chamber in cooperation with the resilient member 12, thus supplying the toner T thereto.

When the toner particles T are supplied to the developing chamber, they are mixed with the magnetic particles M (the particles composed of the resin containing the magnetic powder) existing in the neighborhood of the surface of the sleeve 2 accommodating therein a magnet roller 3. When the sleeve 2 rotates in the direction shown by the arrow A, the developer 4 in the neighborhood of the sleeve surface moves as shown by an arrow C, whereupon the toner particles supplied as described above are gradually mixed into the developer 4.

The developer 4 thus mixed is formed into and applied on the sleeve surface as a developer layer of a proper thickness, for example 100–600 microns, preferably 150–500 microns, by the doctor blade 11. The doctor blade 11 is opposed to the surface of the sleeve 2 at a position between the magnetic pole N1 and S2 of the magnet roller 3 with a clearance, to the surface of the sleeve, of approximately 100–550 microns, preferably 150–450 microns. The doctor blade is fixed at such a position and made of non-magnetic material. The doctor blade is effective to regulate the thickness of the developer layer applied on the surface of the sleeve 2. The thickness of the developer layer is smaller than the clearance formed between the photosensitive drum surface and the sleeve surface in the developing station, so that the surface of the developer layer is out of contact with the surface of the photosensitive drum 1 when not operated.

The non-magnetic particles (toner particles) T in the applied developer 4 have been triboelectrically charged by the friction with the magnetic particles M and/or the friction with the surface of the sleeve 2. With this charged state, the non-magnetic particles are attached by the electrostatic force to the sleeve surface rotating in the direction indicated by the arrow A and are attached to the magnetic particles by the electrostatic force. Therefore, the non-magnetic particles are carried on the surface of the sleeve 2 together with the magnetic particles and conveyed to the developing zone by the rotation of the sleeve 2.

The developing apparatus is so opposed, in the developing zone to the photosensitive drum 1 that the photosensitive drum 1 is opposed to the position of the magnetic roller 3 between the magnetic pole N1 and the magnetic pole S1. Therefore, the developer on the sleeve surface is not formed into an upstanding magnetic brush, thus maintaining a constant and uniform thickness of the layer. So, in order to maintain the developer layer out of contact with the surface of the photosensitive drum 1, it is not necessary to space the sleeve surface from the photosensitive drum surface by a long distance, such as more than approximately 1 mm. Accordingly, it is possible to dispose the sleeve 2 more closely to the drum surface so that a clear and sharp images can be provided due to the effect of the developing electrode which works well when the clearance is small. It has been confirmed that when the clearance is more than approximately 1 mm, unsharp images result.

During the developing action, the alternating voltage is applied between the sleeve 2 and the back electrode 1*a* of the photosensitive drum 1 so as to form an alternating electric field in the developing zone. The alternating voltage is formed with the DC voltage provided by the DC source 5 and the AC voltage provided by the AC source, superposed thereto. It is a possible alternative that only the AC voltage provided by the AC source is used for the bias. The AC voltage is not necessarily in the form of a sine wave, but may be a rectangular or triangular wave. The AC voltage is preferably 200 V–4 KV of the peak-to-peak voltage and 100–4 KHz of the frequency.

EXAMPLE 1

With the developing apparatus described in conjunction with FIG. 2, the development was actually carried out for an electrostatic latent image having a dark area potential Vd of +600 V and a background area potential Vl of 0 V. The developing bias voltage applied was obtained by superposing a DC voltage of +150 V to an AC voltage having the frequency of 1.6 KHz and the peak-to-peak voltage of 1800 Vpp. The non-magnetic particles was toner particles having the weighted average particle size of approximately 8 microns containing as a main component a thermoplastic resin (polystyrene). The non-magnetic particles were negatively chargeable with respect to the magnetic particles. If positively chargeable toner particles are used, a reverse development can be carried out, provided that the DC voltage is selected suitably. The magnetic particles were obtained by kneading resin material containing as a main component styrene-acrylate-aminoacrylate copolymer and 75 wt. % of magnetic powder of magnetite ($Fe_3O_4$), and then pulverizing it into particles of the weighted average particle size of 50 microns. Better images were provided, when not more than 1 wt. % of silica particles were mixed into the above described two component developer, the silica particles having a position in the series of electrostatic charge between the positions of the two particles of the developer.

When the above described bias voltage is applied, and the potential of the sleeve 2 exceeds the threshold in the negative voltage phase, the non-magnetic particles negatively charged are moved across the clearance from the developer layer on the sleeve 2 to the surface of the photosensitive drum 1 at least in the position where the drum 1 and the sleeve 2 are most close, irrespective of whether it is the image area or the non-image area (the background of the image). However, in the phase of the opposite polarity, at least the excessive non-magnetic particles move back to the sleeve 2. These steps are repeated a plurality of times, and then the movement fade out with the reduction of the alternative electric field together with the increase of the clearance between the drum 1 and the sleeve 2, thus terminating the developing action. In order to reduce the alternating electric field, the voltage applied may be decreased.

What is important here is that the magnetic particles are not transferred to the photosensitive drum 1 from the developer layer on the sleeve 2. If the transfer occurs, the magnetic particles in the developing apparatus gradually decreases in the amount, resulting in that the ratio of the number of magnetic particles to the number of non-magnetic particles becomes excessively out of balance. If this ratio (toner particles/magnetic particles) is excessively offset, the background fog can result. It is, therefore, important to confine or retain the magnetic particles on the sleeve surface by the magnetic force.

What is also important is that the photosensitive drum 1 and the sleeve 2 are not too distant in order to avoid unsharp images. If the drum 1 is opposed to a magnetic pole in the developing zone, an upstanding magnetic brush is formed, and therefore, it is difficult to reduce the distance between the drum 1 and the sleeve 2, and additionally it is easy for the undesirable discharge to take place.

In consideration of the above, it is significant that the photosensitive drum 1 is opposed in the developing zone to the position of the magnet roller 3 between the magnetic poles (N1 and S1 in this embodiment).

Figure 3:
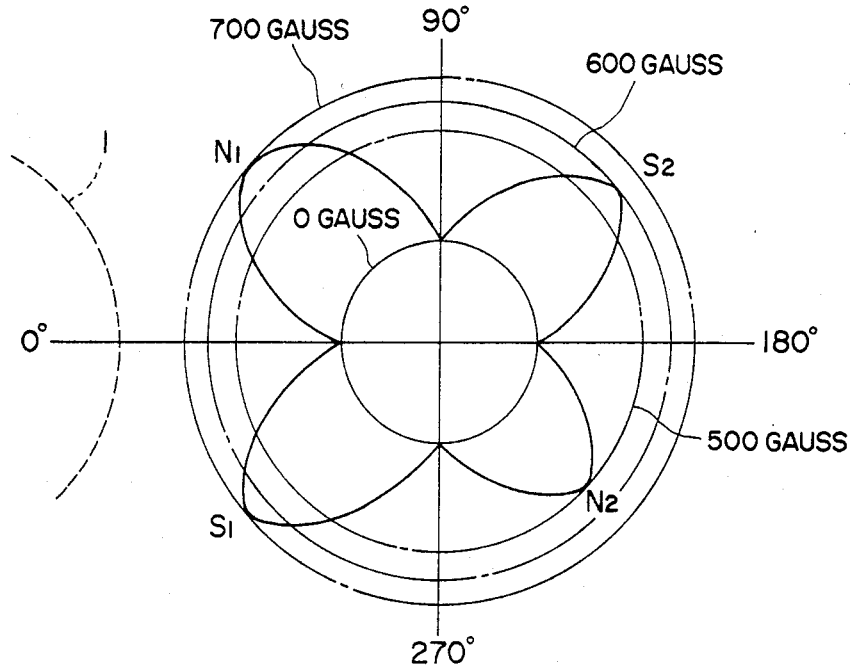
FIG. 3 illustrates a distribution of the magnetic field by a magnet roller in the radial direction.
Figure 4:
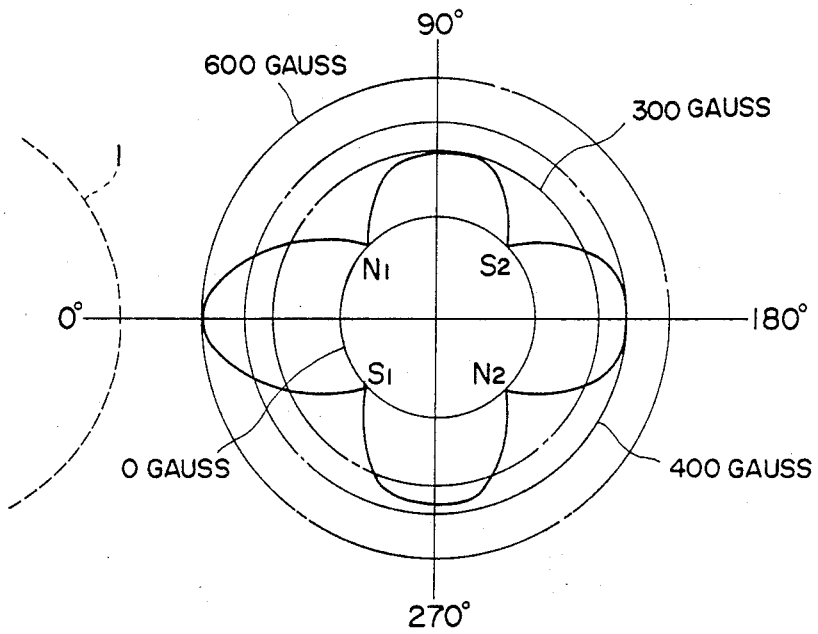
FIG. 4 illustrates a distribution of the magnetic field of the same in the tangential direction.

FIG. 3 illustrates a distribution of the magnetic field provided by the magnetic roll 3. This Figure shows the distribution of radial component of the magnetic field (the strength of the magnetic pole) which is generally used to express the strength of the magnetic field on the sleeve surface. In this Figure, the position of zero degree corresponds to the line, which is horizontal in this embodiment, connecting the center of the drum 1 and that of the sleeve 2. The radial component is the component of the magnetic field extending perpendicularly to the surface of the sleeve 2, and FIG. 3 shows the distribution thereof all around the sleeve surface. It will be noted that the magnetic field is zero Gauss at a point between the magnetic pole N1 and the magnetic pole S1. The experiments carried out by the inventors showed that the magnetic particles were magnetically retained on the sleeve 2 even at the position between the magnetic poles and did not transfer to the photosensitive drum. This would not be readily understood from FIG. 3. However, it would be understood readily in conjunction with FIG. 4 which shows the distribution of the tangential component of the magnetic field on the sleeve surface, using the same coordinate axes. In this embodiment, the tangential component was 600 Gauss between the magnetic poles N1 and S1. It has been confirmed by many experiments that a good quality of images is obtained if the tangential component is not less than 200 Gauss, more preferably not less than 300 Gauss. This is because the magnetic particles are hardly deposited onto the drum 1 when the magnetic field is not less than 200 Gauss. If it is less than that, the magnetic particles tend to deposit onto the drum surface, and this requires that the particle size of the magnetic particles is increased, which results in a decreased concentration of the toner/magnetic particles whereby the concentration control is difficult. Additionally, the developer layer becomes thicker which leads to the increased clearance between the drum 1 and the sleeve 2 so that unsharp images result.

By opposing the position between the magnetic poles to the photosensitive drum, the magnetic particles are effectively and substantially prevented from transferring to the surface of the drum 1, and also the necessity of increasing the clearance between the drum 1 and the sleeve 2 can be eliminated, the increase being needed to avoid the influence of the upstanding magnetic brush and necessarily resulting in unsharp image. Accordingly, the above described conditions are important in this embodiment.

Table 1 indicates the satisfactory conditions of the magnetic particles composed of a resin containing magnetic powder to stably provide a good quality without foggy background.

TABLE 1

| Average particle size (μm) | Magnetic powder content (wt. %) 70 | 60 | 50 | 40 | 30 |
|---|---|---|---|---|---|
| 30 | F | N | N | N | N |
| 40 | G | F | N | N | N |
| 50 | G | F | F | N | N |
| 60 | G | G | F | N | N |
| 70 | G | G | F | N | N |
| 80 | G | G | F | F | N |
| 90 | F | F | F | F | N |
| 100 | F | F | F | F | N |

G: Good
F: Fair
N: Not Practical

In this Table "N" means not practical, "F" practically usable, and "G" more preferable. When the weighted average particle size is less than 30 microns, the magnetic particles transfer to the photosensitive drum 1, which is not practically usable. In the range of the weighted average particle size of 80–100 microns, it is practically usable if the magnetic powder content is not less than 40 wt. %. Exceeding 100 microns, the preferable content of the non-magnetic particles in the developer approaches 10 wt. %, so that the mixture ratio becomes not so different from that of conventional two component developer, which requires strict control of the mixture ratio. It follows that the weighted average particle size of the magnetic particles formed by the resin containing therein the magnetic powder is preferably not less than 30 microns, more preferably not less than 40 microns but not more than 100 microns, further preferably not less than 40 microns but not more than 80 microns. And, the magnetic powder content of the magnetic particle is preferably not less than 40 wt. %. The magnetic particle entirely composed of magnetic material is usable. The magnetic particle formed by a core of magnetic material and a coating therearound of a resin is usable. This is advantageous since it can be easily formed into a spherical shape and can be uniformly charged triboelectrically. A charge controlling agent which may be a pigment or dye may be mixed into the resin constituting the magnetic particle so as to ensure that the non-magnetic particles (toner particles) are charged in the intended polarity and to the intended amount of charge, thus providing a high quality of images.

The developed images with high image density and without a foggy background could be obtained in the broad range of the mixture ratio of the toner particles and magnetic particles, 15 wt. % to 45 wt. %. Because of this broadness, the control of the toner concentration is easier, which is of course advantageous. If the mixture ratio is less than 15 wt. %, the density of the developed image is low, while if it is more than 45 wt. %, the background fog results.

In the description of this embodiment of FIG. 2, the sleeve 2 has been rotated in the direction of the arrow A. However, good images were also obtained when it is rotated in the opposite direction. To rotate the sleeve in the opposite direction rather than the direction of the arrow A was found to be effective to increase the image density in a high speed developing operation.

Regarding the magnetic retention or confinement of the magnetic particles, the relation will be described between the strength of the tangential component of the magnetic field on the sleeve surface between the magnetic poles in the developing zone and the radial component thereof on the sleeve surface at the position of the two magnetic poles (N1 and S1). A stronger radial component of the magnetic field on the sleeve surface at the positions of the magnetic poles, does not necessarily lead a stronger tangential component of the magnetic field at a position between the magnetic poles. If the two magnetic poles are too distant, the tangential component on the sleeve surface at a position between the magnetic poles is reduced, too. On the contrary, if the two magnetic poles are too close, the area between the magnetic poles is narrow, resulting in a narrow proper developing zone, and in addition, the strength of the tangential component of the magnetic field of the sleeve surface is not increased much. In consideration of those, the angle $\theta$ formed between a line connecting the center of the magnet roller 3 (which is the center of the sleeve 2) and one of the magnetic pole (N1) and a line connecting the center of the magnet roller 3 and the other magnetic pole (S1), is preferably satisfies 45 degrees $\leqq\theta\leqq$135 degrees.

In order to stably obtain a high quality of images, the weighted average particle size Dt of the non-magnetic particles (toner) preferably satisfies $$Dt \leqq Dc \leqq 15\ Dt$$

where Dc is the weighted average particle size of the magnetic particles.

If the particle size of the non-magnetic particles is too large as compared with the particle size of the magnetic particles, the non-magnetic particles is insufficiently charged triboelectrically. If it is too small on the contrary, a poor quality of images results.

Additional examples will be described together with a comprison example.

EXAMPLE 2

The clearance between the photosensitive drum 1 and the sleeve 2 was maintained 500 microns, and the thickness of the developer layer was regulated by the doctor blade 11 such that the thickness thereof was 400 microns in the zone where the developer layer was most closely opposed to the photosensitive drum. As for the developer, non-magnetic particles having the average particle size of 8 microns and magnetic particles are mixed. The non-magnetic particle concentration was 30 wt. %. The magnetic powder content in the magnetic particle was 70 wt. %, and the average particle size thereof was 50 microns. The magnetic poles were disposed as shown in FIG. 2 so that a position between the magnetic poles was opposed to the drum 1. The magnetic poles N1 and S1 provided the magnetic field having the radial component of 700 Gauss. The strength of the tangential component between the magnetic poles was 610 Gauss.

Under the above conditions, development was carried out for an electrostatic latent image having a dark potential Vd of −600 V and the background potential V1 of 0 V. The non-magnetic particles (toner particles) were positively chargeable. The developing bias used was provided by superposing a DC voltage of −150 V with an AC voltage having the peak-to-peak voltage Vpp of 1800 V and the frequency of 1.6 KHz. It was recognized that only the non-magnetic particles transferred to the image area (Vd), none of the magnetic praticles and non-magnetic particles were deposited on the non-image area, so that a good quality of image was provided without a foggy background.

COMPARISON EXAMPLE

The developing operation was carried out under the same conditions as Example 2 with the exception that the magnetic particle contained 30 wt. % of the magnetic powder and had the average particle size of 40 microns. The magnetic particles found to be deposited on the non-image area so that a good image could not be obtained.

EXAMPLE 3

The developing operation was carried out under the conditions similar to Example 2 so as to effect a reverse development wherein the light area of the image, that is, the background area was visualized. In this Example, the dark potential of the latent image was −600 V, and the light potential V1 was −50 V. The non-magnetic particles used were negatively chargeable. The developing bias applied was provided by superposing a DC voltage of −450 V with an AC voltage having the peak-to-peak voltage Vpp of 1800 V and the frequency of 1.6 KHz. It was recognized that only the non-magnetic particles were transferred to the light part of the drum which was the image part in this Example, and that none of the magnetic particles and non-magnetic particles was deposited to the dark part which was the non-image area in this Example. Thus, a good reverse development was carried out.

Also, when the latent image was of positive polarity good images were obtained as in the case described above by employing non-magnetic particles positively chargeable and employing the DC voltage of +450 V.

As described in the foregoing, according to this embodiment of the present invention, the surface of the developer carrying member behind which magnetic field producing means is provided, carries a layer of a developer including the magnetic particles containing not less than 40 wt. % magnetic powder and including the non-magnetic particles mixed thereto and mainly consisting of the resin. In the developing zone, the latent image bearing member is opposed to a position between the magnetic poles of the magnetic field producing means behind the developer carrying member. The strength of the tangential component of the magnetic field on the developer carrying surface is not less than 200 Gauss, preferably not less than 300 Gauss. The clearance between the surfaces of the latent image bearing member and the developer carrying member is larger than the thickness of the developer layer in the developing zone. Across the clearance, an alternating electric field is formed to transfer the non-magnetic particles from the developer layer on the developer carrying member to the latent image bearing member while retaining the magnetic particles on the developer carrying member surface, irrespective of whether it is the image area or the non-image area. And, the excessive non-magnetic particles are transferred back to the developer carrying member. These steps are alternatingly repeated. By doing so, the following advantageous effects result in combination.

(1) The resultant developed image is of sufficient image density even for a solid black image, without edge effect, which could not be obtained by conventional non-contact type developing method.

(2) The image quality is sharp without blur.

(3) The magnetic particles are subtantially untransferred to the latent image bearing member, so that the developed part does not contain the magnetic particles mixing into the non-magnetic particles. This makes a clear and bright color development possible.

(4) A wasteful consumption of the magnetic particles can be avoided.

(5) Since the magnetic brush is not used in the developing zone, and since the developing zone is located between the magnetic poles, the area where the thickness of the developer layer is uniform can be used for development, so that a uniform effect of the opposing electrode (developing electrode) can be provided, whereby uniform image quality of the development is made possible.

While the invention has been described with reference to the structures disclosed herein, it is not confined to the details set forth and this application is intended to cover such modifications or changes as may come within the purposes of the improvements or the scope of the following claims.

What is claimed is:

1. A developing method, comprising:

providing a developer carrying member, behind which magnetic field producing means is disposed;

carrying a developer layer comprising a mixture of non-magnetic particles and insulative magnetic particles having a volume resistivity of $10^{13}$ ohm-cm or higher measured under no pressure and under an electric field of 1000 volts per square centimeter between electrodes on a surface of the developer carrying member;

disposing in a developing zone the developer layer such that a latent image bearing member is opposed to a tangential magnetic field formed between two magnetic poles of opposite polarities of the magnetic field producing means disposed behind the developer carrying member, with the clearance larger than the thickness of the developer layer between the surfaces of the latent image bearing member and the developer carrying member; and forming an alternating electric field in the clearance to transfer the non-magnetic particles from the developer carrying member to the latent bearing member while retaining the magnetic particles on the surface of the developer carrying member, thus developing a latent image on the image bearing member.

2. A method according to claim 1, wherein a strength of a tangential component of the magnetic field on the developer carrying member is not less than 200 Gauss.

3. A method according to claim 1, wherein the two magnetic poles of the magnetic field generating means are spaced apart from each other by an angle which is not less than 45 degrees but not more than 135 degrees.

4. A method according to claim 1, wherein the latent image bearing member and the developer carrying member are moved counter-directionally in the developing zone.

5. A method according to claim 1, wherein said magnetic particles are spherical in shape.

6. A method according to claim 1, wherein said magnetic particles each include a resin containing magnetic powder.

7. A method according to claim 6, wherein the magnetic particles each contain the magnetic powder, the amount of which is not less than 40 wt. %.

8. A method according to claim 7, wherein the average particle size of the magnetic particles is not less than 30 microns but not more than 100 microns.

9. A developing apparatus for developing a latent image carried on a latent image bearing member, comprising:

movable developer carrying means for carrying a developer which is a mixture of non-magnetic particles and insulative magnetic particles;

magnetic field producing means so arranged that said developer carrying means lies between said magnetic field producing means and the latent image bearing member;

means for forming and maintaining between said developer carrying means and the latent image bearing member a clearance larger than the thickness of the developer layer formed on said developer carrying member; and means for forming an alternating electric field in the clearance;

wherein said developing apparatus is so fixed with respect to the latent image bearing member that the latent image bearing member is opposed to a tangential magnetic field formed between two magnetic poles of opposite polarities of said magnetic field producing means.

10. An apparatus according to claim 9, wherein said means for maintaining the clearance maintains a clearance of not less than 200 microns and not more than 800 microns.

11. A developing apparatus comprising:

(a) a rotatable developer carrying member of non-magnetic material for carrying a layer of developer containing a mixture of insulative magnetic carrier particles and insulative toner particles electrically chargeable to a polarity opposite to that of the carrier particles;

(b) magnetic field generating means disposed across said developer carrying member from the developer layer, said magnetic field generating means having two stationary magnetic poles of different polarities to form a magnetic field of 200 gauss or higher in a tangential direction of said developer carrying member at a developing position where the developer carrying member is close to a latent image bearing member for carrying an image to be developed; and (c) means for applying an alternating electric field to reciprocate the toner particles in the developing position which are electically charged, between the latent image bearing members and the developer carrying member.

12. An apparatus according to claim 11, wherein the alternating electric field is a superposed AC and DC field, and wherein the magnetic poles provide a magnetic field of 300 gauss or more.

13. An apparatus according to claim 12 wherein said developer carrying member includes a cylindrical sleeve, and wherein said magnetic field generating means includes a magnet having four magnetic poles and being retained stationary within said sleeve.

14. An apparatus according to claim 13, wherein two of said magnetic poles which form said magnetic field are spaced by a central angle of not less than 45° and not more than 135°.

15. An apparatus according to claim 11, further comprising a container for containing the developer, a member for regulating thickness of the developer discharged from said container and means for maintaining the same potential at said regulating member and at said developer carrying member.

16. An apparatus according to claim 11, wherein the toner particles are present in amounts from 15 to 45 weight percent and the magnetic particles are present in amounts from 55 to 85 weight percent based on the weight of the mixture of toner and magnetic particles.

17. An apparatus according to claim 11, wherein the gap between the latent image bearing member and the developer carrying member is from 300 to 600 microns.

18. An apparatus according to claim 11, wherein said developer carrying member includes a cylindrical sleeve, and wherein said magnetic field generating means includes a magnet having four magnetic poles and being retained stationary within said sleeve.

19. An apparatus according to claim 18, wherein three magnetic poles other than those forming said magnetic field have such polarities that adjacent magnetic poles have the same polarity.

20. A developing method comprising:

providing a developer carrying member, behind which magnetic field producing means is disposed;

carrying a developer layer comprising a mixture of non-magnetic particles and insulative magnetic particles on a surface of the developer carrying member;

disposing in a developing zone the developer layer such that a latent image bearing member is opposed to a tangential magnetic field formed between two magnetic poles of different polarities of the magnetic field producing means disposed behind the developer carrying member, with the clearance larger than the thickness of the developer layer between the surfaces of the latent image bearing member and the developer carrying member; and forming an alternating electric field in the clearance to transfer the non-magnetic particles from the developer carrying member to the latent image bearing member, thus developing a latent image on the image bearing member.

21. A method according to claim 20, wherein a strength of a tangential component of the magnetic field on the developer carrying member in not less than 200 gauss.

22. A method according to claim 20, wherein the two magnetic poles of the magnetic field generating means are spaced apart from each other by an angle which is not less than 45 degrees but not more than 135 degrees.

23. A method according to claim 20, wherein said insulative magnetic particles have a resistivity not less than $10^{12}$ ohm-cm.

24. A method according to claim 20, wherein said magnetic particles are spherical in shape.

25. A method according to claim 20, wherein said magnetic particles each include a resin-containing magnetic powder.

26. A developing method comprising;

providing a developer carrying member, behind which magnetic field producing means is disposed;

carrying a developer layer comprising a mixture of non-magnetic particles and insulative magnetic particles on a surface of the developer carrying member;

disposing in a developing zone the developer layer such that a latent image bearing member is opposed to a tangential magnetic field formed between two magnetic poles of different polarities of the magnetic field producing means disposed behind the developer carrying member, with the clearance larger than the thickness of the developer layer between the surfaces of the latent image bearing member and the developer carrying member; and forming an alternating electric field in the clearance to the non-magnetic particles from the developer carrying member to the latent image bearing member, thus developing a latent image on the image bearing member;

wherein an average particle size of the magnetic particles is not less than 50 microns but not more than 100 microns, and each of the magnetic particles contains resin and magnetic material, and the content of the magnetic material is not less than 50 weight % based on the total weight of the magnetic particles.

27. A developing method comprising;

providing a developer carrying member, behind which magnetic field producing means in disposed;

carrying a developer layer comprising a mixture of non-magnetic particles and insulative magnetic particles on a surface of the developing carrying member;

disposing in a developing zone the developer layer such that a latent image bearing member is opposed to a tangential magnetic field formed between two magnetic poles of different polarities of the magnetic field producing means disposed behind the developer carrying member with the clearance larger than the thickness of the developer layer between the surfaces of the latent image bearing member and the developer carrying member; and forming an alternating electric field in the clearance to transfer the non-magnetic parficles from the developer carrying member to the latent image bearing member, thus developing a latent image on the image bearing member;

wherein an average particle size of the magnetic particles is not less than 40 microns but not-more than 100 microns, and each of the magnetic particles contains resin and magnetic material, and the content of the magnetic material is not less than 60 weight % based on the total weight of the magnetic particles.

28. A developing method comprising:

providing a developer carrying member, behind which magnetic field producing means is disposed;

carrying a developer layer comprising a mixture of non-magnetic particles and insulative magnetic particles on a surface of the developer carrying member;

disposing in a developing zone the developer layer such that a latent image bearing member is opposed to a tangential magnetic field formed between two magnetic poles of different polarities of the magnetic field producing means disposed behind the developer carrying member with the clearance larger than the thickness of the developer layer between the surfaces of the latent image bearing member and the developer carrying member; and forming an alternating electric field in the clearance to transfer the non-magnetic particles from the developer carrying member to the latent image member, thus developing a latent image on the image bearing member;

wherein an average particle size of the magnetic particles is not less than 30 microns but not more than 100 microns, and each of the magnetic particles contains resin and magnetic material, and the content of the magnetic material is not less than 70 weight % based on the total weight of the magnetic particles.

29. A method according to claim 26, 27 or 28, wherein a strength of a tangential component of the magnetic field on the developer carrying member is not less than 200 gauss.

30. A method according to claim 29, wherein the two magnetic poles of the magnetic field generating means are spaced apart from each other by an angle which is not less than 45 degrees but not more than 135 degrees.

* * * * *

UNITED STATES PATENT AND TRADEMARK OFFICE
CERTIFICATE OF CORRECTION

PATENT NO. : 4,653,427

DATED : March 31, 1987

INVENTOR(S) : AKIHITO HOSAKA, ET AL.

It is certified that error appears in the above-identified patent and that said Letters Patent is hereby corrected as shown below: Title page:

AT [57] IN THE ABSTRACT

Line 7, "bearing member to" should read --bearing member is opposed to--.

COLUMN 1

Line 47, "consisting" should read --consist--.
Line 67, "will be" should be deleted.

COLUMN 2

Line 48, method," should read --methods,--.

COLUMN 4

Line 59, "preferbly" should read --preferably--.

COLUMN 6

Line 52, "images" should read --image--.

COLUMN 7

Line 11, "was" should read --were--.
Line 50, "decreases in the" should read --decrease in--.

UNITED STATES PATENT AND TRADEMARK OFFICE

CERTIFICATE OF CORRECTION

PATENT NO. : 4,653,427

DATED : March 31, 1987

INVENTOR(S) : AKIHITO HOSAKA, ET AL.

It is certified that error appears in the above-identified patent and that said Letters Patent is hereby corrected as shown below:

COLUMN 10

Line 4, "is" should be deleted.
Line 16, "is" should read --are--.
Line 51, "praticles" should read --particles--.
Line 60, "found" should read --were found--.

COLUMN 12

Line 26, "latent bearing" should read --latent image bearing--.

COLUMN 13

Line 32, "electically" should read --electrically--.
Line 39, "12" should read --12,--.

COLUMN 14

Line 57, "to the" should read --to transfer the--.

COLUMN 15

Line 5, "developing" should read --developer--.
Line 17, "parficles" should read --particles--.
Line 22, "not-more" should read --not more--.

UNITED STATES PATENT AND TRADEMARK OFFICE
CERTIFICATE OF CORRECTION

PATENT NO. : 4,653,427

DATED : March 31, 1987

INVENTOR(S) : AKIHITO HOSAKA, ET AL.

It is certified that error appears in the above-identified patent and that said Letters Patent is hereby corrected as shown below:

COLUMN 16

Line 14, "image" should read --image bearing--.

Signed and Sealed this

Eighth Day of March, 1988

*Attest:*

DONALD J. QUIGG

*Attesting Officer*

*Commissioner of Patents and Trademarks*